United States Patent [19]

Marcon

[11] Patent Number: 4,805,535

[45] Date of Patent: Feb. 21, 1989

[54] PROJECTILE

[76] Inventor: Robert V. Marcon, 3471 Sinnicks Avenue, Niagara Falls, Ontario, Canada, L2J 2G6

[21] Appl. No.: 48,929

[22] Filed: May 13, 1987

[51] Int. Cl.[4] ..... F42B 11/00

[52] U.S. Cl. ..... 102/503; 102/439; 102/448; 102/517

[58] Field of Search ..... 102/501, 503, 514–519, 102/703, 448, 439

[56] References Cited

U.S. PATENT DOCUMENTS

| | | | |
|---|---|---|---|
| 590,428 | 9/1897 | Bennett | 102/503 |
| 1,053,844 | 2/1913 | Mauser | 102/516 |
| 1,292,388 | 1/1919 | Bowers | 102/503 |
| 2,433,334 | 12/1947 | Birkeland | 102/503 |
| 3,345,949 | 10/1967 | Nosler | 102/516 |
| 3,545,383 | 12/1970 | Lucy | 102/703 |
| 3,880,083 | 4/1975 | Wasserman et al. | 102/703 |
| 4,381,712 | 5/1983 | Black | 102/503 |
| 4,384,528 | 5/1983 | Moore et al. | 102/503 |
| 4,627,357 | 12/1986 | Gobis | 102/503 |

FOREIGN PATENT DOCUMENTS

| | | | |
|---|---|---|---|
| 2806641 | 8/1978 | Fed. Rep. of Germany | 102/503 |

*Primary Examiner*—Harold J. Tudor
*Attorney, Agent, or Firm*—Donald C. Studley

[57] ABSTRACT

The present invention relates to projectiles that are particularly useful in guns having smooth bores, but it is equally useful in guns having either smooth or rifled bores. The present projectiles are cylindrical, tubular composites comprised of low density and high density materials. The present projectiles have a heavier forward portion and a lighter rearward portion. The distance from a point at the rear of the projectile to a plane perpendicular to the axis of the projectile and passing through the center of mass of the projectile is from about 1.0 to about 5.0, and more preferably from about 1.2 to about 1.8, and most preferably from about 1.2 to about 1.6, times the distance from a corresponding point at the front of the projectile to such plane. The present projectiles may also include a guidance system consisting of internal vanes, or fins, positioned within the projectile body. The present projectiles present substantially less head-on surface area when the projectile is in flight. Thus the initial velocity of the projectile decreases at a substantially slower rate than projectiles now in use. The design of the present projectiles enables the projectiles to have a flatter trajectory and carry more kinetic energy to the target.

17 Claims, 2 Drawing Sheets

PROJECTILE

The present invention relates to projectiles, and more particularly to hollow, or tubular projectiles, useful in guns. The terms "gun" or "guns" as used herein includes firearms ranging from handguns, or pistols, to large bore weapons. Therefore, it is to be understood that although the present invention will hereinafter be described primarily in terms of projectiles, or bullets, useful in small caliber arms, the utility and advantages of the invention are equally applicable to larger projecticles, such as, shot or shells, useful in guns of larger caliber, for example, cannons, howitzers and mortars.

Various proposals have been made over the years for increasing the velocity of projectiles as they move through a gun barrel in order to obtain, and maintain, the highest possible velocity of the projectile after it leaves the barrel.

When a gun is fired the propellant charge (usually in a cartridge) is rapidly converted into a gas. The gas-pressure curve from the instant of ignition to the instant that the projectile leaves the muzzle is ideally an adiabatic curve. As a practical matter, however, the propellant charge does not instantly burn and resistant forces are present. Such resistant forces as inertia of the projectile and friction between the projectile and the interior of the barrel must be overcome before the projectile can be propelled through the gun barrel.

Ideally the gas pressure reaches a minimum value as the projectile leaves the barrel. If the pressure remains high after the projectile leaves the barrel, it is an indication that a portion of the propellant charge has not been fully utilized. If the internal pressure within the barrel drops too low, it indicates that the projectile did not reach its maximum velocity when it left the barrel. However, irrespective of the caliber or bore of the gun, the muzzle velocity (the velocity of the projectile at the time that it leaves the muzzle of the gun) tends toward a maximum value which cannot be further increased by the use of greater amounts of propellant without determental results to the gun.

Thus, means other than increasing the propellant charge have been sought to increase the projectile velocity. For example, it has been proposed to utilize lighter weight projectiles, or projectiles whose calibers are less than the gun barrel in order to reduce internal friction and to increase internal velocity. In the latter arrangements the projectile is usually inserted into a base member which fits snugly within the barrel The base member drops off after the projectile leaves the gun barrel and because of its smaller size, the projectile receives a more powerful acceleration from the gas pressure than would a projectile of normal Typical examples of previous proposals to increase the projectile velocity by the use of lighter projectiles are: U.S. Pat. Nos. 998,307 and 2,409,307; British Pat. No. 483,983 and; Swiss Pat. No. 10,736.

When the projectile leaves the barrel of the gun it immediately encounters drag. Drag is the air resistance to the forward motion of the projectile. Any increase in velocity produces an increase in drag. Typically projectiles in use today have a tapered forward portion, ogive, attached to a rearward cylindrical portion. Such external shape enables the projectile to minimize drag and attain a favorable ballistic trajectory. Drag may be determined by measurement of the rate of loss of forward velocity as a function of the distance flown. For a spinning or non-spinning axially symetrical projectile in perfect alignment with the direction of flight, drag would be the predominant aerodynamic force encountered. However, as a practial matter, when a projectile leaves the gun barrel, lift and other forces come into being causing various unstabilizing effects on the projectile, for example, magness effect, pitching, pitch-damping, rolling, yawing, and tumbling. It has been proposed to utilize hollowed or hollow projectiles to obtain a high flight velocity Typical examples of the use of hollowed projectiles having minimum drag and light weight are: U.S. Pat. Nos. 2,345,619 and 3,063,376. Examples of hollow tubular projectiles are: U.S. Pat. No. 1,292,388 and German Patent Specifications Nos. 2,642,187 and 2,806,641. The use of such hollowed or hollow projectiles has not proven practical because of their extreme instability in flight, particularly when fired from a smooth bore gun.

A number of conflicting proposals have been made to prevent tumbling (keyholing) and to stabilize such lighter and hollow projectiles in flight in rifled guns. For example, U.S. Pat. No. 1,053,844 and Swiss Pat. No. 10,736 propose to position the center of gravity in the forward portion of the projecticle, U.S. Pat. No. 1,053,845 proposes the placement of the center of gravity in the center of the projectile, while U.S. Pat. Nos. 3,357,357 and 4,338,862, British Pat. No. 125,428 and Swiss Pat. No. 347,454 propose to position the center of gravity in the rear portion of the projectile.

Typically projectiles that are presently in wide use are stabilized in flight by spinning the projectile around its longitudinal axis. The resulting gyroscopic stabilization keeps the projectile from tumbling, thereby maintaining the proper orientation during flight and minimizing drag. The spin on a shell or projectile is imparted by rifling, usually lands and grooves, within the gun barrel. When the gun is fired a driving band on the projectile engages the rifling and causes the projectile to spin around its longitudinal axis. Such spinning motion stabilizes the projectile in flight and keeps it aligned, i. e., with nose pointing forward The friction required to impart rotation is a force that must be overcome by a sacrifice of velocity Examples of prior art which propose to obtain rotation and reduce friction are U.S. Pat. Nos. 2,045,833; 3,063,376 and 3,345,949.

The present projectile provides a means of obtaining a high projectile velocity within the gun barrel, in either smooth or rifled barrels, a high flight velocity, and excellent stability in flight. The present projectile also provides a means of obtaining accurate and steady projectile flight. The trajectory of the present projectile is substantially flat, which provides extreme accuracy in small caliber arms at target distances of up to 1000 yards.

The attributes of the present projectile allow guns with compartitively short barrels to be extremely accurate, such guns are substantially more portable The present projectiles provide high accuracy in guns with unrifled, or smooth, bores, such guns can be more economically manufactured. The present projectiles substantially reduce the wear on the gun barrel, and also substantially reduce the heat generated within the gun barrel, the barrels on such guns would have a life estimated to be a minimum of three times the typical rifle in use today.

BRIEF DESCRIPTION OF THE INVENTION

The present invention relates to projectiles particularly useful in guns having smooth bores, but it is equally useful in guns having either smooth or rifled bores. The present projectiles are cylindrical, tubular composites comprised of low density and high density materials. The present projectiles have a heavier forward portion and a lighter rearward portion. The distance from a point at the rear of the projectile to a plane perpendicular to the axis of the projectile and passing through the center of mass of the projectile is from about 1.0 to about 5.0, and more preferably from about 1.2 to about 1.8, and most preferably from about 1.2 to about 1.6, times the distance from a corresponding point at the front of the projectile to such plane. While the distance ratio varies in accord with the materials utilized in the fabrication of the projectile, the most commonly used materials will place the ratio in a range of from about 1.2 to about 1.8, and more preferably from about 1.2 to about 1.6. The present projectiles may also include a guidance system consisting of internal vanes, or fins, positioned within the projectile body. The present projectiles present substantially less head-on surface area when the projectile is in flight. Thus the initial velocity of the projectile decreases at a substantially slower rate than projectiles now in use. The design of the present projectiles enables the projectiles to have a flatter trajectory and carry more kinetic energy to the target.

DETAILED DESCRIPTION OF THE INVENTION AND PREFERRED EMBODIMENTS OF THE INVENTION

The invention will now be described in detail by reference to the accompanying drawings which are to be interpreted as illustrative, and not limiting Like components are identified by like numbers throughout each of the several views.

FIG. 1 also illustrates the weight ratio, or weight distribution, of the present projectiles.

Figure 5:
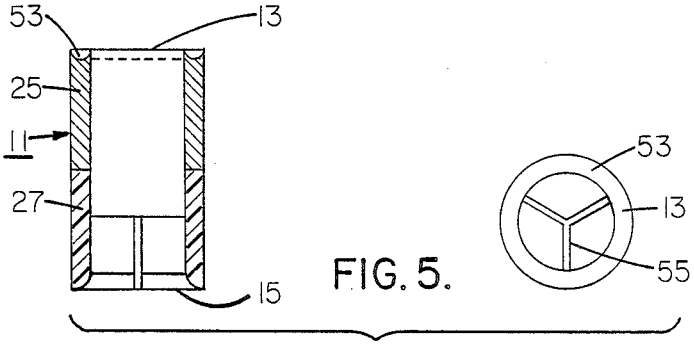
Figure 6:
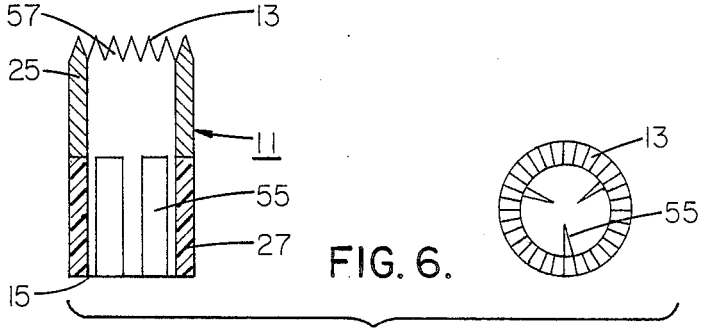
Figure 7:
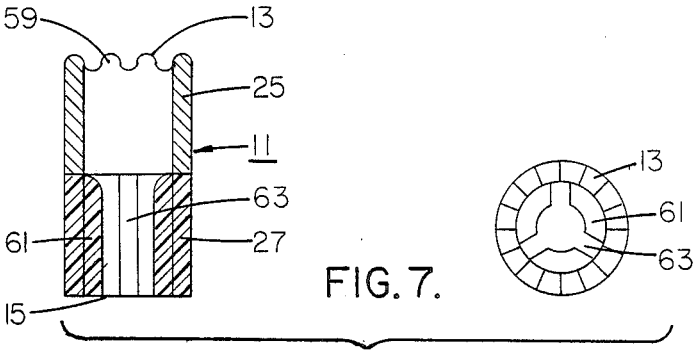

FIGS. 5, 6, and 7 are composite vertical front and top elevational views, partly in section, illustrating various embodiments of the internal guidance systems that may be suitably utilized with the present projectile Further these figures illustrate additional alternative shapes that may be made in the projectile edges.

Figure 1:
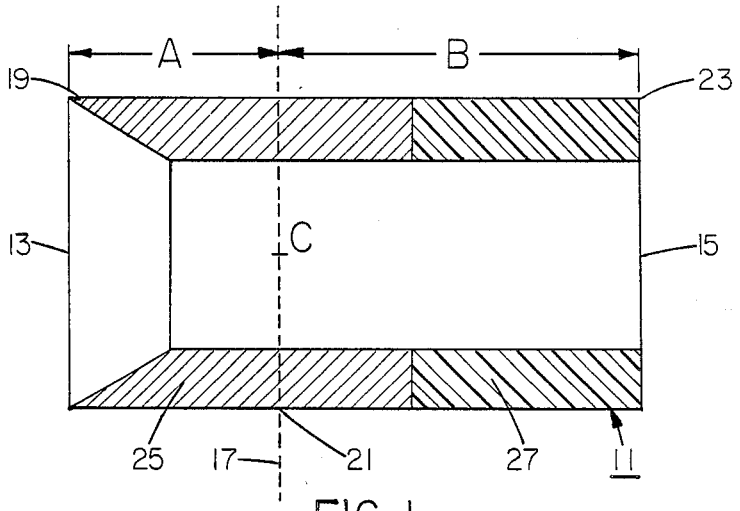
FIG. 1 is a longitudinal front elevational view, in section, of a composite cylindrical projectile of the present invention.

Looking now at FIG. 1, the present tubular projectile, generally indicated as 11, has a front, or leading, end 13 and an aft, or rear, end 15. Projectile 11 has a heavier forward portion and a lighter rearward portion. The center of mass, or center of gravitity, is located at point C. Vertical plane 17 (designated by dashed lines) is positioned perpendicular to the axis of projectile 11 and passes through point C. The linear distance from any point on front end of projectile 11 to plane 17 is designated as distance A. The corresponding linear distance from a corresponding point on aft end of projectile 11 to plane 17 is designated as distance B. For example, the distance from point 19 on front end 13 to point 21 on the periphery of the projectile would be distance A, while the corresponding distance from point 23 on aft end 15 to point 21 would be designated as B. Distance B is always greater than distance A, that is, the center of gravity is always toward the front of the projectile. It has been found that stable accurate trajectories are obtained when distance B ranges from about 1.0 to about 5.0, more preferably and more typically useful from about 1.2 to about 1.8, and most preferably from about 1.2 to about 1.6, times greater than distance A.

Projectile 11 is of composite construction, preferably fabricated of at least two materials varying in density to facilitate the required weight distribution. It will be understood that the junctions of the materials used to fabricate the present projectiles do not have to be exactly aligned with the junctions of distances A and B to fulfill the weight distribution requirement. For example, the weight distribution requirement may be fulfilled utilizing a forward portion 25 which may be fabricated of a relatively heavy material, such as, lead, copper, brass, iron, tungsten or titanium, or mixtures of heavier materials, while the rearward portion 27 may be fabricated of a relatively lighter material, such as, a light metal, e.g., aluminum, magnesium, or a ceramic material, wood, or plastics, or mixtures of lighter materials. Suitable plastics include, thermosetting and thermoplastic resins, such as, phenolics, polycarbonates, polypropylene, urethanes or polyethylene. Projectile 11 may be fabricated by forming a matrix of a relatively light material, such as, a plastic, or a ceramic material, and utilizing a heavier material, for example, metal pellets, pebbles or sand, embodied or embedded therein contiguous to the required heavier front end. Alternately the projectile may be fabricated having a matrix of a heavier material with a embedded lighter material concentrated in the required lighter aft end. The present projectile may also be fabricated with the required weight ratio using a single material in two or more phases, for example, a metal, or plastic material which can have both a solid and a foamed, or expanded, form. The foamed, or expanded, portion may be utilized in the aft end of the projectile and the solid portion in the front end. For the purposes of the present invention mixtures of such higher and lower density materials are considered composites.

Figure 2:
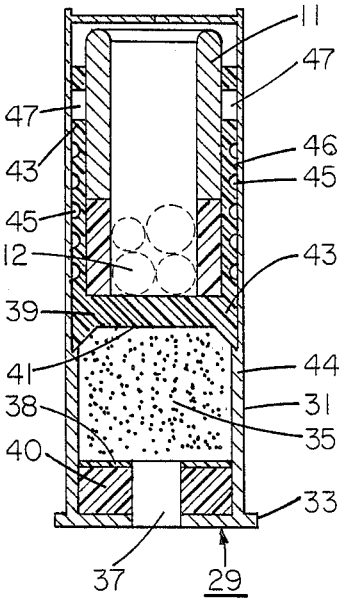
FIG. 2 is a vertical front elevational view, in section, of a cartridge utilizing a composite projectile of the present invention.
Figure 3:
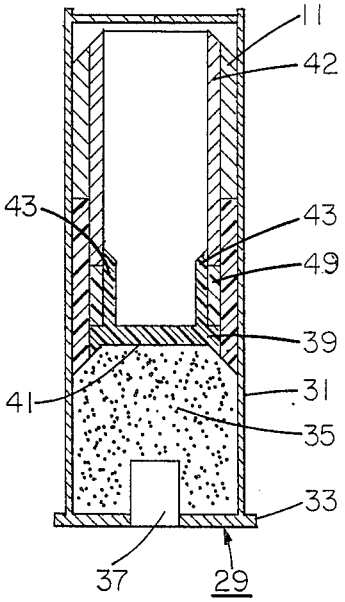
FIG. 3 is also a vertical front elevational view, in section, of an embodiment that is particularly useful in guns having rifled barrels.
Figure 4:
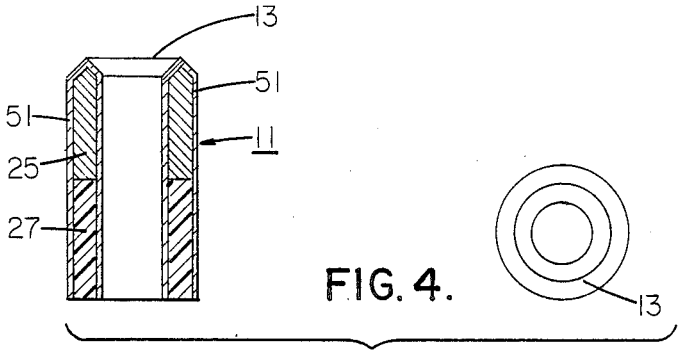
FIG. 4 is a vertical front elevational view in section illustrating alternative shapes that may be utilized on the edges of the projectile and also illustrating the inclusion of an outer jacket.

In FIG. 1 the leading edge of front end 13 is beveled, or tapered, inward. It will be understood that the leading edge portion of front end 13 and the trailing edge portion of aft end 15 may have other configurations, for example, they may be square, they may rounded as shown in FIG. 2, or may be tapered inward, as shown in FIG. 3, pointed, as shown in FIG. 4, cupped, as shown in FIG. 5, serrated, as shown in FIG. 6, or scalloped as shown in FIG. 7. It will be understood that the edges on a single projectile do not have to be matched. For example, the forward edge may have one configuration and the rear edge may have another.

It will also be understood that the outer surface of projectile 11 may have configurations other than smooth, for example, the outer surface the projectile may be serrated, that is, rifled, scalloped, or ringed, In such embodiment the surface of the projectile that would come in contact with the interior surface of the gun barrel as the projectile travels through the barrel would be reduced. In this manner friction between the projectile and the gun barrel would be reduced.

FIG. 2 shows the present projectile 11 positioned in a standard, or conventional, cartridge 29. Typically cartridge 29 has a shell wall 31, a rim 33, a propellent 35, e.g., gunpowder, and a percussion cap, or detonator 37. A wad means 39 is positioned between the propellant 35 and projectile 11. Wad means 39 is suitably fabricated of a plastic material, for example, polypropylene or polyethylene. Wad means 39 has a solid base portion 41 and may have a support means, such as 44. The purpose of the wad means is to provide a substantially gas tight seal between the propellant and the projectile so that the expanding gases generated by the propellant act to propell the wad means and projectile through the gun barrel at a rapid rate. Wad means 39 is separable from projectile 11. As the projectile leaves the gun barrel, the wad means becomes detached from the projectile by air flow through the tubular projectile. Wad means 39 may suitably be fabricated with a plurality of extentions, or serrations, such as 43, which, in FIG. 2 are shown extending around the outside of projectile 11 and are positioned in contact with the inside wall of cartridge 29. In such embodiment the wad means allow smaller caliber projectiles to be accurately fired from guns having larger calibers. Such embodiment is particularly useful in smooth bore guns. Extentions 43 may be solid or may be perforated. Extentions 43 may also aid in releasing the wad means 39 from projectile 11 by air flow between extentions 43 and the projectile body as the projectile leaves the gun barrel. Extentions 43 may have a plurality of annular ridges, such as, 45, extending transversely around the periphery thereof. Perforations, such as 47, and ridges, such as, 46, reduce the mass and decrease the friction of the projectile and wad means that the propellant must move through the gun bore, substantially increasing the speed of the projectile through the gun barrel. Ridges 45 may also provide a particularly suitable means of utilizing the present projectiles in a gun having a rifled barrel. In such use the outermost diameter of the area containing ridges 45 is suitably sized to be substantially the same diameter as the bore groove in the rifled gun barrel and the diameter at the depth of ridges 45 is equal to or slightly less than the bore diameter. In use in a rifled barrel, the outside wall of projectile 11 is not forced into the rifle grooves, rather the ridged portion of wad means 39 enters the rifle grooves and the projectile rides atop the rifle grooves, substantially reducing the wear within the gun barrel.

FIG. 2 also illustrates the inclusion of a crushable, or compressible, portion, 40, suitably in the form of a disc, positioned in the base portion of cartridge 29. Compressible portion 40 may appropriately be fabricated of a compressible plastic or foam material, for example, polystyrene Suitably a packing disc, such as 38, may be positioned atop compressible portion 40. The purpose of compressible portion 40 is to absorb a portion of the initial expansion of gases within cartridge 29 and provide an smoother acceleration to projectile 11 as it enters the gun barrel.

FIG. 2 further illustrates an alternative embodiment of the invention in which supplemental projectiles, such as, shot, granules, flechettes, or similar smaller missiles, shown as 12, in dashed lines, may be positioned in the hollow center portion of projectile 11.

FIG. 3 illustrates an embodiment particularly adapted to use in rifled barrels. In this embodiment projectile 11 has an inner, single piece, tubular core, 42, of a substantially incompressible metal, e. g., hardened steel, maintained out of contact with the gun barrel by the outer surface of projectile 11. In this embodiment of the invention the projectile exibits armor piercing properties. As further shown in FIG. 3, the outside of projectile 11 is positioned against the inside of cartridge 29 and extentions 43 on wad means 39 are positioned within the inner portion of projectile 11. A ring of compressible material 49 may aptly be included intermediate the wad means and the projectile to absorb shock and to more evenly distribute the expansion forces within the cartridge when it is fired.

FIG. 4 is a sectional view of a projectile of the present invention wherein the projectile edges, 13, are pointed and the projectile has a jacket, or outside casing, 51. Jacket 51 may be continuous, that is, it may cover the entire projectile, or it may selectively cover only the inner, outer or edge portions. Jacket 51 may be metallic, such as those known in the art, suitably fabricated of steel, brass or copper, or it may be plastic, suitably of a thermosetting plastic, or it may be ceramic. It will be understood that the weight distribution requirement of the present invention is inclusive of the jacket weight.

FIGS. 5, 6 and 7 illustrate internal guidance systems that may suitably be included in the present invention. The present guidance system becomes operable as the projectile leaves the gun barrel and the wad means is detached. The air flow through the projectile is utilized to improve, or maintain the trajectory of the projectile. The guidance system may also impart or retard a spin on the projectile.

FIG. 5 illustrates a further alternative that may be made in the projectile edges 13 and 15. In this embodiment the end portions of the edges are cupped, or dished, that is, they have an annular groves, such as 53. FIG. 5 also illustrates a guidance system that may be utilized in the present projectiles. As shown in FIG. 5, vanes or fins 55 are positioned in the inside surface of projectile 11. Such vanes may extend substantially the entire internal length of projectile 11, more preferably they extend from about 1/16 to about $\frac{1}{4}$ of the internal length. Vanes, such as 55, are suitably positioned in the rearmost two-thirds, and more preferably in the rearmost one half of the projectile, and most preferably in the rearmost one-third. The number and length of the vanes is limited by the amount of air flow desired to pass through projectile 11. Generally the number of vanes varies from one to four. The vanes, or fins may be separated or joined within projectile 11. As shown in FIG. 5, the vanes are joined in the center of projectile 11. The vanes may be have a tapered shape, or be canted to deflect the air flow in a desired manner. The vanes, either continuous, or separate, may be positioned in serpentine manner within projectile 11 to impart a desired spin to the projectile. The vanes may be utilized to impart a spin to the projectile when it is fired from a smooth bore gun. The vanes may be arranged to impart additional spin when the projectile is fired from a rifled gun, or to decrease the spin from a rifled gun if it is desired to slow the speed of the projectile, or cause the projectile to follow a shorter, erratic flight.

FIG. 6 illustrates a further alternative embodiment of edges 13 and 15 of projectile 11. As shown in the figure the edges are serrated, having points, or teeth, such as, 57. FIG. 6 also illustrates an alternative guidance system wherein the vanes, or fins, do not extend completely across the internal area of projectile 11. Such vanes may be utilized as alternatives to the arrangements described in the foregoing to achieve similar results.

FIG. 7 illustrates a further alternative shape for edges 13 and 15 of projectile 11. In this figure the edges are shown as having scallops 59. FIG. 7 also illustrates an alternative guidance system in which a portion, preferably less than about ½ the length of projectile 11, is thickened. Thickened wall portion 61 has grooves, such as 63, therein. Grooves 63 are typically 1/64 to 1/16 inches is depth. Grooves 63 may extend substantially parallel to the axis of projectile 11 or may be cut in a serpentine pattern. Grooves 63 perform, or may be adaped to perform, functions similar to those performed by vanes or fins described in the foregoing.

It will be apparent that many widely different embodiments of the present invention maybe made without departing from the spirit and scope thereof. It is therefore not intended that the invention be limited except as recited in the following claims.

What is claimed is:

1. A composite cylindrical tubular projectile usseful in guns having rifled or unrifled bores, said projectile having a hollow center portion, a front end and an aft end, (a) said front end being fabricated of a material relatively heavier than the material used to fabricate the aft end, said front end having a forward leading edge portion and a rearward end portion, (b) said aft end being fabricated of a separate and relatively lighter material that the material used to fabricate the said front end, said aft end extending substantially completely only rearwardly from the rearward end portion of said front end, said aft end having a trailing edge portion, (c) the distance from a point on said aft end to a plane passing through the center of gravity of the porjectile and perpendicular to the axis of the projectile being from about 1.2 to about 1.8 times the distance from a corresponding point on the front end of said projectile to said plane, and (d) a separable wad means positioned contiguous to the aft end of said projectile providing a substantially gas tight seal across said aft end while the projectile is propelled through a gun barrel.

2. The projectile of claim 1 wherein the distance from said point on said aft end to said plane passing through the center of gravity of the projectile and perpendicular to the axis of the projectile being from about 1.2 to about 1.6 times the distance from said corresponding point on the front end of said projectile to said plane.

3. The projectile of claim 1 wherein said projectile has a guidance system, comprised of a plurality of vanes positioned within said hollow center portion of said tubular projectile.

4. The projectile of claim 3 wherein said guidance system is positioned within the rearmost one third of said projectile.

5. The projectile of claim 1 wherein the leading edge of said projectile is tapered inward.

6. The projectile of claim 1 wherein the leading edge of said projectile is tapered outward.

7. The projectile of claim 1 wherein the leading edge of said projectile is rounded.

8. The projectile of claim 1 wherein the leading edge of said

9. The projectile of claim 1 wherein the trailing edge of said projectile is tapered outward.

10. The projectile of claim 1 wherein the trailing edge of said projectile is tapered inward.

11. The projectile of claim 1 wherein the trailing edge of said projectile is rounded.

12. The projectile of claim 1 wherein the hollow center portion of said projectile contains supplemental missiles.

13. The projectile of claim 12 wherein the said supplemental missiles are shot.

14. The projectile of claim 12 wherein the said supplemental missiles are flechettes.

15. The projectile of claim 1 wherein said projectile has a single piece inner tubular core of a substantially imcompressible metal.

16. The projectile of claim 1 wherein said projectile has an outside jacket, or casing, fabricated of metal, plastic or ceramic.

17. The projectile of claim 1 wherein the outside surface of said projectile is serrated.

* * * * *